US005161329A

United States Patent [19]

Brown

[11] Patent Number: 5,161,329

[45] Date of Patent: Nov. 10, 1992

[54] INSULATED CLOSURE STRUCTURE

[76] Inventor: Noel S. Brown, 10 Hopson Rd., Jacksonville Beach, Fla. 32250

[21] Appl. No.: 801,737

[22] Filed: Dec. 3, 1991

[51] Int. Cl.[5] ..... E06B 1/10

[52] U.S. Cl. ..... 49/380; 49/470; 49/478; 49/505

[58] Field of Search ..... 49/380, 467, 470, 478, 49/505

[56] References Cited

U.S. PATENT DOCUMENTS

| | | | |
|---|---|---|---|
| 3,673,735 | 7/1972 | Winsler et al. | 49/478 X |
| 3,757,473 | 9/1973 | Mundy | 49/380 |
| 4,006,562 | 2/1977 | Belanger et al. | 49/380 |
| 4,180,944 | 1/1980 | Stowik et al. | 49/380 X |
| 4,831,780 | 5/1989 | Bockwinkel | 49/478 X |
| 4,941,289 | 7/1990 | Rolek | 49/478 |

*Primary Examiner*—Philip C. Kannan
*Attorney, Agent, or Firm*—Thomas C. Saitta

[57] ABSTRACT

A closure structure for a walk-in freezer or refrigerator unit capable of being mounted into a rectangular opening, the structure comprising a U-shaped inner frame member and a U-shaped outer frame member which are connected at a mating lip and mating flange to form a C-shaped channel to receive the wall around the rectangular opening, a threshold member mounted flush with the floor and a hingedly mounted door member. The inner frame member has an insulating material mounted to correspond to the rectangular opening. Sealing may be enhanced by provision of a magnetic door gasket and metal strip. A double wiper strip on the bottom of the door is positioned to contain a heated strip mounted in the threshold.

6 Claims, 2 Drawing Sheets

INSULATED CLOSURE STRUCTURE

BACKGROUND OF THE INVENTION

This invention relates generally to the field of closure structures, and more particularly to the field of closure structures for use with refrigerator or freezer units. The invention further relates particularly to the field of closure structures which are doors in walk-in freezer or refrigerator units. Even more particularly, the invention relates to the field of closure structures able to be retrofitted into existing freezer or refrigerator units, whereby a smaller or damaged closure assembly can be replaced by the invention.

Walk-in freezer or refrigerator units are large, enclosed spaces used for storage of perishable items. In many situations, pallet jacks or other means of transporting pallets of stored goods are used to put in or remove the goods from the freezer or refrigerator units. In these situations, it is necessary to have a threshold flush with the inner and outer floors. The standard doors built into the freezer or refrigerator units are too small to allow easy maneuvering of the pallet jacks, with the result that the doors and frames are easily damaged and often require replacement. Typical replacement closures known in the art are units which are affixed externally to the outer wall. These units protrude into the workspace, are weak in respect to thermal barrier properties, and are easily damaged.

The replacement closures must perform the same functions as the original closures. They must maintain the temperature differential between the inside of the freezer or refrigerator unit and the outside. The closure should not allow moisture condensation to form on the exterior. The threshold of the closure must remain free of ice to prevent hazardous footing conditions. The replacement closure must be sufficiently insulated and sealed at all points to prevent thermal leakage into the walls or around the door.

The invention provides a replacement closure assembly which meets all the criteria set forth above. The invention allows a damaged door, or a too small door, to be replaced quickly and efficiently with a closure which is superior in properties to the original closure. The invention is structured in separate parts which allow it to be assembled onto the existing building wall and wall of the original freezer or refrigerator unit by cutting out a rectangular access opening of appropriate size around the original door location, or at any location where a new closure door is desired. The invention is structured such that the exterior of the door portion of the closure assembly mounts relatively flush to the original wall, while the entire unit is securely mated to the wall and an excellent thermal barrier is created.

SUMMARY OF THE INVENTION

The invention comprises a closure assembly which can be mounted onto existing freezer or refrigerator units after the creation of a suitably sized rectangular opening in the wall of the unit and/or the building wall containing the unit. The closure assembly comprises four main components—an insulated door, an inner frame member, and outer frame member and a threshold member—which are combined to create the fully assembled closure structure.

The inner frame member and outer frame member are both substantially U-shaped in overall configuration, each having two parallel legs and a perpendicular cross piece, and are adapted to be joined together such that the frame members enclose the vertical sides and top of the rectangular opening in the wall. In cross-section, the joined framed members are substantially C-shaped, such that the joined frame members create a channel to receive the wall of the freezer or refrigerator unit and/or the building wall. The frame members have structural reinforcements for rigidity and may have insulation members attached. The threshold member forms the floor portion of the closure assembly and interfits with the bottoms of the frame members, whereby the threshold member and the frame members will encircle the entire rectangular opening in the wall.

The door member is mounted onto the outer frame member, the two being adapted such that the exterior side of the door member is flush with the exterior side of the outer frame member when the door is closed. The outer frame member and door member are correspondingly structured to allow for a sealing gasket to be positioned along the full extent of the outer frame member at the puncture point between the two components to create a thermal seal between the frame member and the door. A flexible wiper member is connected to the bottom of the door member, extending the full length of the threshold member, and depends beneath the door member a distant sufficient to contact the threshold member in order to wipe excess moisture off of the threshold member and to create the necessary thermal barrier along the bottom of the closure assembly.

Preferably, the sealing gasket incorporates a magnetic material and a metal strip is positioned along the outer frame member along the contact zone to allow for improved sealing. This metal strip is heated to prevent ice build-up. A heated metal strip is also preferably inserted into the threshold member for the same purpose. The wiper member along the door bottom should preferably consist of two depending flexible bands, positioned such that the heated metal strip is between the two when the door is closed. This creates a temperature differential which prevents moisture and ice accumulation on the exterior or along the threshold.

DETAILED DESCRIPTION OF THE INVENTION

The invention will now be described in detail, providing a preferred embodiment and best mode for its practice. For purposes of this disclosure, references to the interior, inside or inner shall mean the side facing or the direction into the interior of the refrigerator or freezer unit, while references to the exterior outside or outer shall mean the side external to or the direction out of the refrigerator or freezer unit.

Figure 1:
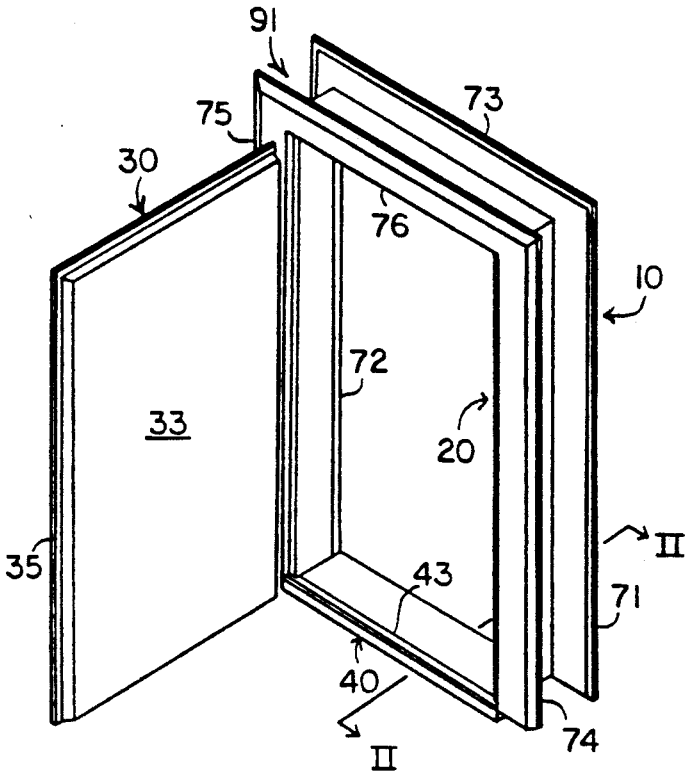
FIG. 1 is a perspective view of the closure assembly showing the door member in the open position.

FIG. 1 provides an exposed view of the invention with all the component parts combined and connected. The closure assembly comprises in combination an inner frame member 10, an outer frame member 20, a door member 30, and a threshold member 40. The completed assembly thus provides a sealable closure for a rectangular opening in the refrigerator or freezer unit, with the inner frame member 10, outer frame member 20 and threshold 40 encompassing the complete periphery of the rectangular opening, and the door member 30 providing means of ingress and egress. Inner frame member 10 and outer frame member 20 are joined together to create a channel to envelope and receive a portion of the wall 99 around the rectangular opening. Wall 99 may be the wall of the freezer or refrigerator unit, the wall of the building containing the unit, or both, the invention being adapted to be compatible with any such situation.

Figure 2:
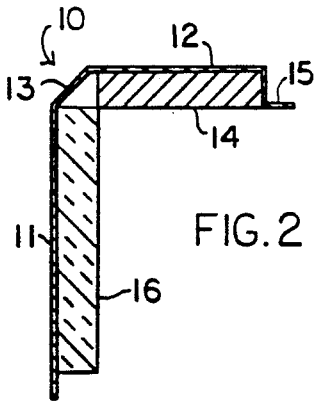
FIG. 2 is a cross-sectional view of the inner frame member, taken along line II—II of FIG. 1.

Inner frame member 10 is substantially U-shaped, having two downwardly depending leg portions 71 and 72 and a top cross member 73 connecting the two. The leg portions 71 and 72 correspond to and connect with the jamb or vertical sides of the rectangular opening, while the top cross member 73 corresponds and connects to top of the opening. With reference to FIG. 2, the inner frame member 10 is shown in cross-section to comprise a mating flange 11 and an inner flange 12 positioned substantially perpendicularly to each other. Mating flange 11 is positioned to correspond to the vertical sides and top of the rectangular opening in wall 99, while inner flange 12 is adapted to parallely correspond to a portion of the inside of wall 99 around the rectangular opening. Preferably, the mating flange 11 and inner flange 12 are connected with a bevelled member 13, but the components can be joined at a right angle. Mating flange 11 is preferably planar and extends a sufficient length towards the exterior to cover substantially the full width of wall 99. Inner flange 12 extends sufficient distance along the inside of wall 99 to allow for connection of the inner flange 11 t the inside of wall 99 and is preferably configured to allow for attachment of an inner reinforcing member 14 along legs 71 and 72 and cross member 73 for increased rigidity. Inner reinforcing member 14 may be made of any suitably rigid material, such as wood or metal. Inner flange 12 may also be provided with an edge shoulder 15 to enclose the inner reinforcing member 14 and allow for a flush inner mounting to the inside of wall 99. A frame insulating member 16 is preferably connected to mating flange 11 along legs 71 and 72 and cross member 73 such that an improved thermal barrier is created between inner frame member 10 and the wall 99. Frame insulating member 16 can be made of any suitable insulating material, but is preferably made of lightweight and low cost material such as expanded urethane foam. Inner frame member 10, except for the insulating member 16 and reinforcing member 14, is preferably made of a plastic or fiberglass material and should be of the minimal thickness necessary for structural rigidity.

Figure 3:
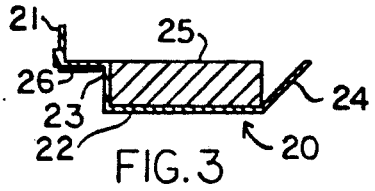
FIG. 3 is a cross-sectional view of the outer frame member, taken along line II—II of FIG. 1.
Figure 5:
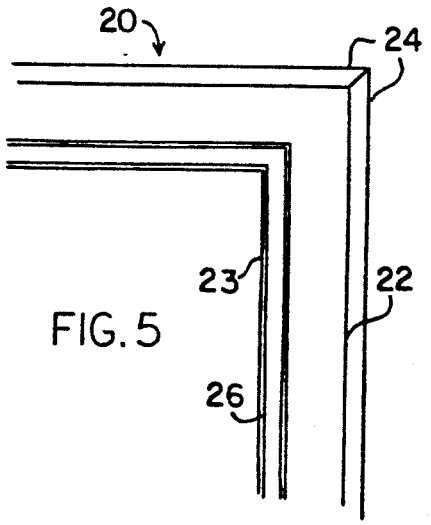
FIG. 5 is an exterior view of a portion of the outer frame member.

Outer frame member 20 is of an overall configuration corresponding to inner frame member 10, outer frame member 20 having a substantially U-shape with two depending leg portions 74 and 75 and a top cross member 76 connecting the two. With reference now to FIG. 3, the cross-sectional configuration of outer frame member 20 is shown to comprise a mating lip portion 21 joined substantially perpendicularly to an outer flange 22. Mating lip 21 extends a short distance from outer flange 22 and is adapted to receive a portion of mating flange 11 whereby the conjunction of mating flange 11 and mating lip 21 results in a relatively flush exposed surface. Mating lip 21 corresponds to and adjoins the vertical sides and top of the rectangular opening in wall 99, while outer flange 22 parallelly corresponds to and adjoins a portion of the exterior of wall 99 around the opening. Referring now also to FIG. 5, outer flange 22 comprises a door receiving recess 23 into which is mounted a metal strip 26, this metal strip 26 extending the full length of legs 74 and 75 and cross member 76. Metal strip 26 provides a sealing surface to which the magnetic gasket 31 adheres. Preferably, metal strip 26 is electrically heated, such as by the inclusion of resistance wires, to prevent ice build-up on the door receiving recess 23. Any ice build-up would interfere with gasket 31 tightly sealing against the metal strip 26, resulting in breaks in the thermal barrier. As with the inner frame member 10, outer frame member 20 has an outer reinforcing member 25 of wood or like material connected to the legs 74 and 75 and cross member 76 to provide structural rigidity. Outer flange 22 preferably ends with angled shoulder 24 to provide a flush connection to the exterior side of wall 99. Outer frame member 20 is preferably constructed of plastic or fiberglass materials with the minimal thickness required for rigidity.

Figure 4:
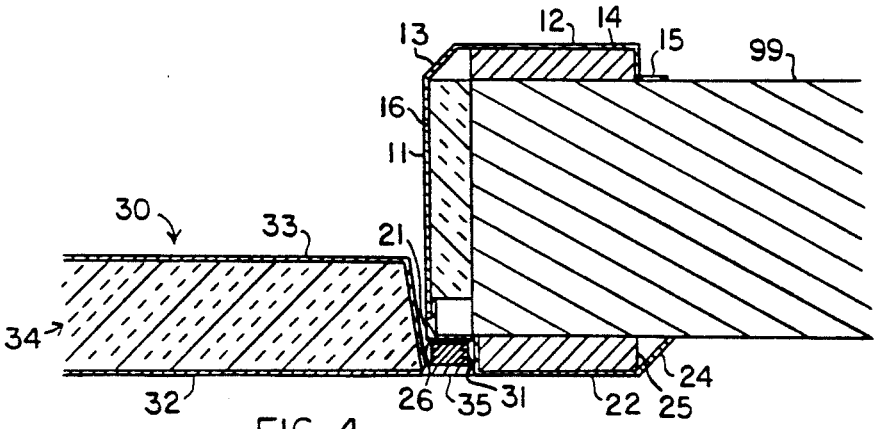
FIG. 4 is a cross-sectional view of the joined frame members and a portion of the door member in the closed position, taken along line IV—IV of FIG. 7.
Figure 7:
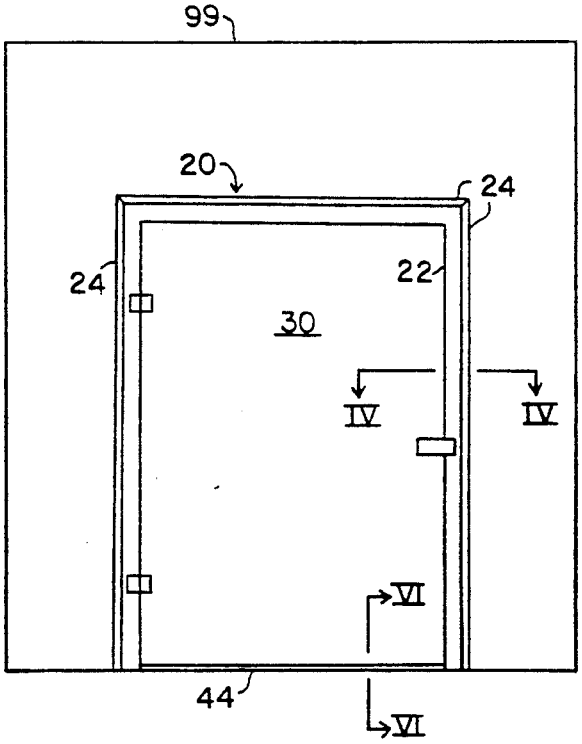
FIG. 7 is an exterior view of the door member and outer frame member in the closed position.

With reference to FIG. 4, the combination of inner frame member 10, outer frame member 20 and door member 30 in relation to wall 99 is illustrated. Inner frame member 10 and outer frame member 20 are connected by attaching the end portion of mating flange 11 of inner frame member 10 to the mating lip 21 of outer frame member 20 along the entire length of both frame members. This attachment can be made by any suitable means, such as by adhesives or mechanical fasteners, whereby a sturdy and complete joining of the two frame members is accomplished. Connection of the inner frame member 10 and outer frame member 20 creates the C-shaped channel 91 which encases the exposed edges of wall 99 around the rectangular opening. Mating flange 11 and mating lip 21, along with frame insulating member 16, abut and adjoin the vertical sides and top of the rectangular opening, while the inner flange 12 and inner reinforcing member 14 abut and adjoin the interior of wall 99 and outer flange 22 and outer reinforcing member 25 abut and adjoin the exterior of wall 99.

Door member 30 is adapted to mate with the outer frame member 20, being mounted by hinge members 92. Preferably, door member 30 has an outer surface 32 and an inner surface 33 constructed of lightweight yet strong plastic or fiberglass material encasing a lightweight insulating material 34, such as an expanded urethane foam. The inner surface 33 of door 30 is angled inwardly around its periphery so that a relatively thick door can be utilized without interfering with the swinging movement during opening and closing. The thin door lip 35 provides the surface for the gasket 31, which extends along the top and side portion of door 30. Gasket 31 is preferably made of a flexible or resilient plastic or rubber material and is preferably magnetized. Door lip 35 corresponds to and mates with the door receiving recess 23 of outer frame member 20, such that the gasket 31 meets along its entire length with metal strip 26 to form a complete and tight seal, and the relatively planar outer surface 32 of door 30 lies flush with the outer flange 22 of outer frame member 20.

Figure 6:
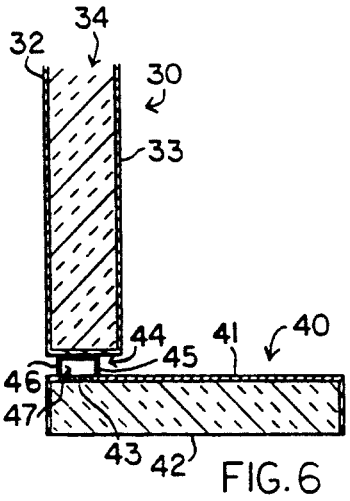
FIG. 6 is a cross-sectional view of the threshold member and a portion of the door member in the closed position, taken along line VI—VI of FIG. 7.

Referring now to FIG. 6, the construction of the threshold 40 and bottom of door 30 is shown. Threshold 40 is adapted to have a relatively planar upper surface 41 which is mounted level with the floor of the building and the refrigerator or freezer unit so as to provide a smooth surface with no interferences for pallet jacks. Threshold member 40 is also preferably constructed of a lightweight plastic or fiberglass material having minimal thickness. Insulating material 42 is attached to the underside of threshold 40 to provide a thermal barrier in this direction. A heating strip 43 is mounted into a groove in the upper surface 41 of threshold 40, the heating strip 43 being a metal strip containing electrical wiring for resistance heating. Heating strip 43 extends the length of threshold 40 at a position corresponding to the location of the underside of door 30 in the closed position. Threshold member 40 is keyed to correspond to the bottoms of the inner frame member 10 and outer frame member 20, whereby the combination of the threshold member 40, inner frame member 10 and outer frame member 20 completely encircles the rectangular opening in wall 99.

The underside of door 30 is relatively rectangular. Depending from the bottom of door 30 is wiper member 44 which creates the thermal seal along the bottom of the rectangular opening in wall 99. Wiper member 44 is preferably comprised of two parallel mounted strips 45 and 46 of a flexible plastic or rubber material, extending the length of the bottom of door 30 and hanging a sufficient distance below door 30 to contact threshold 40. Inside strip 45 and outside strip 46 are separated a sufficient distance whereby they are positioned on either side of heating strip 43. The underside of door 30, wiper member 44 and the upper surface 41 of threshold 40 creates a heated enclosed space 47 to prevent ice formation. Wiper member 44 is preferably made of sufficiently rigid material such that the motion of door 30 during opening and closing wipes clean the upper surface 41 of threshold 40.

To install the closure assembly, a rectangular opening is cut into the wall and, if necessary, the threshold area is cut out a short amount. The threshold 40 is placed in position and permanently attached flush with the surface of the floor of the building. The inner frame member 10 is then positioned inside the unit such that the mating flange 11 is inserted into the rectangular opening. The outer frame member 20 is then positioned from the outside of the unit such that the mating lip 21 is inserted into the opening. The end of the mating flange 11 is seated into the mating lip 21 and the inner frame unit 10 and outer frame unit 20 are permanently joined by adhesive means or mechanical fasteners. Likewise, the frame members are attached to the wall 99. With the two frame members now joined and the threshold 40 in place, the rectangular opening is completely encircled by the apparatus. A total thermal barrier prevents heat transfer into the interior of the wall or into the floor area. Door member 30 is then attached to the outer frame member by hinges 92, and the unit is compete.

It is to be understood that the above examples are by way of illustration only, and that substitutions and equivalents may be obvious to those skilled in the art. The full scope and definition of the invention therefore is to be as set forth and defined in the following claims.

I claim:

1. An insulated closure structure for a rectangular opening in the wall of a walk-in refrigerator or freezer unit having an interior side and an exterior side, said rectangular opening having a top, bottom and vertical sides, comprising in combination:

a substantially U-shaped inner frame member having two depending legs and a top cross member, said inner frame member further comprising a mating flange adapted to correspond to the vertical sides and top of said rectangular opening and an inner flange connected substantially perpendicularly to said mating flange and adapted to parallelly correspond to a portion of the interior side of said wall, said inner frame member further comprising an insulating member attached to said mating flange to adjoin said top and vertical sides of said rectangular opening;

a substantially U-shaped outer frame member having two depending legs and a top cross member, said outer frame member further comprising a mating lip adapted to correspond to the vertical sides and top of said rectangular opening, and an outer flange connected substantially perpendicularly to said mating lip and adapted to parallelly correspond and adjoin to a portion of the exterior side of said wall, said outer flange comprising a door receiving recess, whereby said mating lip receives and is fastened to a portion of said mating flange to create a flush surface, such that the combination of inner frame member and outer frame member encompass said vertical sides and top of said rectangular opening, and the combination of the inner frame member and outer frame member form a C-shaped channel to receive a portion of said wall;

a threshold member having a relatively planar upper surface adapted to correspond to the bottom of said rectangular opening, said threshold member adapted to adjoin said inner frame member and outer frame member, whereby the combination of said threshold member, said inner frame member and said outer frame member completely encircles said rectangular opening;

and a door member hingedly mounted onto said outer frame member, said door member adapted to mate with said door receiving recess of said outer frame member to completely seal said rectangular opening, said door member further comprising a flexible depending wiper member adapted to contact said threshold member.

2. The device of claim 1, further comprising a flexible gasket member mounted onto said door member to correspond to said door receiving recess.

3. The device of claim 2, where said gasket member is magnetic, and said inner frame member further comprises a metal strip mounted on said door receiving recess.

4. The device of claim 1, where said threshold member further comprises a heating strip mounted in said upper surface.

5. The device of claim 4, where said door wiper member comprises two separate flexible strips and said heating strip is positioned to be between said two flexible strips when said door member is in the sealed position.

6. The device of claim 1, further comprising reinforcing members attached to said inner flange of said inner frame member and to said outer flange of said outer frame member.

* * * * *